United States Patent [19]

Wagner

[11] Patent Number: 4,921,392

[45] Date of Patent: May 1, 1990

[54] SIDESHIFT MOUNTED BACKHOE LOCKING MECHANISM

[75] Inventor: Oryn B. Wagner, Bismarck, N. Dak.

[73] Assignee: Clark Equipment Company, South Bend, Ind.

[21] Appl. No.: 193,907

[22] Filed: May 13, 1988

[51] Int. Cl.[5] ..... E02F 5/02

[52] U.S. Cl. ..... 414/695; 212/189; 280/766.1

[58] Field of Search ..... 414/695, 695.5–695.8, 414/705; 172/673; 280/766.1; 212/189, 200, 182

[56] References Cited

U.S. PATENT DOCUMENTS

| | | | |
|---|---|---|---|
| 3,250,410 | 5/1966 | Dorkins | 214/138 |
| 3,266,647 | 8/1966 | Ziskal et al. | 214/138 |
| 3,304,100 | 2/1967 | Long | 280/456 |
| 3,343,686 | 9/1967 | Bjerkan | 212/66 |
| 3,405,823 | 10/1968 | Williams | 214/138 |
| 3,494,636 | 2/1970 | Magee | 280/456 |
| 3,891,065 | 6/1975 | Iijima et al. | 188/41 |
| 3,993,206 | 11/1976 | Jomen et al. | 414/695 |
| 4,111,319 | 9/1978 | Matsuyoshi et al. | 214/131 |
| 4,140,232 | 2/1979 | Myers et al. | 214/138 |
| 4,741,663 | 5/1988 | Kennedy | 414/695.5 |

FOREIGN PATENT DOCUMENTS

| | | |
|---|---|---|
| 2453948 | 11/1980 | France . |
| 1067614 | 11/1963 | United Kingdom . |

*Primary Examiner*—Robert J. Spar
*Assistant Examiner*—Donald W. Underwood
*Attorney, Agent, or Firm*—Kinney & Lange

[57] ABSTRACT

A backhoe is mounted to a rear portion of a loader by means of a locking sideshift mount. The sideshift mount includes a main frame fixedly mounted to the loader, and a slide frame which is slidably mounted to the main frame for transverse movement between the left and right sides of the loader. A pair of locking apertures open downwardly from a lower surface of the slide frame. A pair of stabilizers are mounted to the rear portion of the loader, adjacent the left and right sides of the main frame. Locking pins on the stabilizers extend upward and are cooperable with the locking apertures. When the slide frame and backhoe are positioned on the left or right side of the main frame, and the stabilizers retracted by hydraulic cylinders, the locking pins will engage the slide mount and prevent movement of the backhoe.

9 Claims, 4 Drawing Sheets

SIDESHIFT MOUNTED BACKHOE LOCKING MECHANISM

BACKGROUND OF THE INVENTION

1. Field of the Invention

The present invention relates generally to backhoe mounting mechanisms. In particular, the present invention is a locking mechanism for a sideshift backhoe.

2. Description of the Prior Art

Sideshift mounted backhoes are commonly used for excavation. These implements are typically mounted to a rear portion of a loader or other vehicle by means of a sideshift mount. The backhoe can then be shifted or moved in a transverse direction to any desired position between the opposite sides of the loader. When shifted to the outer ends of the mount adjacent the sides of the loader, the backhoe can be effectively used for excavation immediately adjacent an above-the-ground or subsurface structure. In one known design, the operator will actuate the backhoe against the ground and force it to slide to the desired position about the rear portion of the loader. The backhoe is generally shifted to the left or right side of the sideshift mount, retracted, and turned in a transverse direction, when the loader is traveling.

Vehicles to which backhoes are mounted typically include stabilizers on their rear outboard sides. The stabilizers are individually driven by hydraulic cylinders in response to operator actuation of control valves. When lowered or extended during excavation, the stabilizers more securely position or stabilize the vehicle. Hydraulic locks are often used in the stabilizer's hydraulic drive circuit to prevent fluid from leaking from the hydraulic cylinders after the stabilizers have been positioned. The stablizers can then be securely locked in their retracted position when the vehicle is traveling, and in their extended position during excavation.

There is a continuing need for improved sideshift backhoe mounting mechanisms. A locking mechanism for positively securing the backhoe on the sideshift mount during vehicle travel is desired. The locking mechanism must be efficient and reliable.

SUMMARY OF THE INVENTION

The present invention is a loader having a locking sideshift backhoe. The backhoe is movably mounted to a rear portion of the loader by sideshift mounting means which permits transverse movement of the backhoe between the loader's left and right sides. A pair of stabilizers are mounted to the rear portion of the loader adjacent opposite sides of the sideshift mounting means, and are movable between extended and retracted positions. Stabilizer drive means drive and position the stabilizers between their retracted and extended positions. Locking means on at least one of the stabilizers engage the sideshift mounting means and prevent movement of the backhoe when the stabilizer is driven to its retracted position.

In one embodiment the sideshift mounting means includes a main frame and a slide frame. The main frame is fixedly mounted to the rear portion of the loader, while the slide frame is mounted to the main frame for transverse movement. The backhoe is mounted to the slide frame. The slide frame includes a lower portion having downwardly opening locking apertures. The locking means includes upwardly extending locking pins on the stabilizers. The locking pin on one of the stabilizers will engage one of the locking apertures when the slide frame is positioned adjacent a side of the loader and the stabilizers are driven to their retracted positions.

In still other embodiments the stabilizer drive means includes hydraulic cylinders for driving the stabilizers. Valves couple the hydraulic cylinders to a tank in a hydraulic circuit. Hydraulic locks couple the valves to the hydraulic cylinders and help ensure continued engagement of the locking pin and aperture when the stabilizers are retracted.

DETAILED DESCRIPTION OF THE PREFERRED EMBODIMENTS

Figure 1:
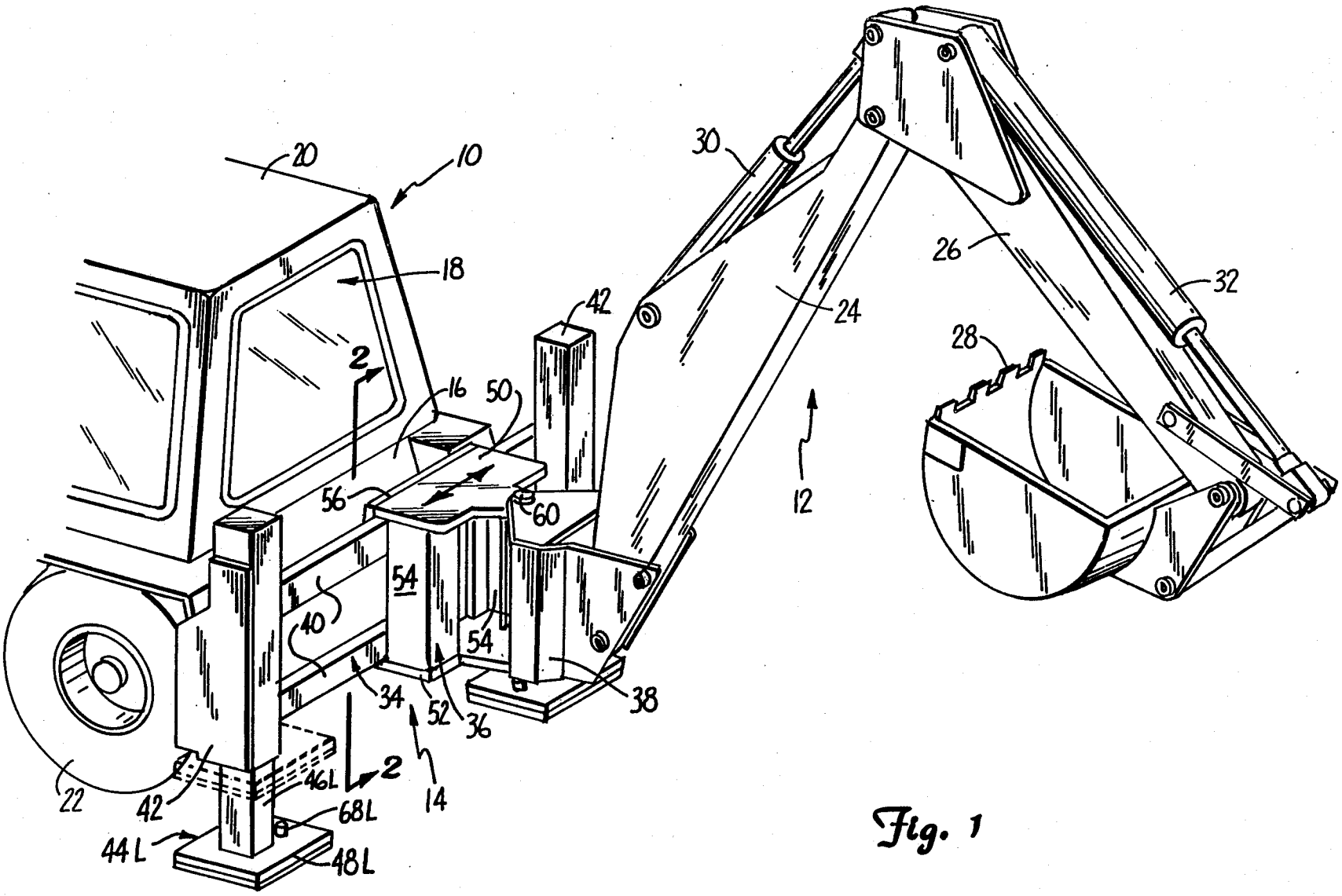
FIG. 1 is a perspective view of a rear portion of a loader which includes a locking sideshift mount and backhoe in accordance with the present invention.

A loader 10 which includes a backhoe 12 and locking sideshift mount 14 in accordance with the present invention is illustrated generally in FIG. 1. Loader 10 can be of any known or conventional design, and only its rear portion including frame 16, operator compartment 18, cab 20, and ground engaging drive wheels 22 are shown. Backhoes such as 12 are also well known and include a boom arm 24, dipper arm 26, and bucket 28. Boom arm 24 is pivotally mounted at its lower end to sideshift mount 14, and is driven with respect to the sideshift mount by a hydraulic boom drive cylinder (not visible). Dipper arm 26 is pivotally mounted to boom arm 24, and is driven with respect to the boom arm by means of hydraulic dipper cylinder 30. Bucket 28 is pivotally mounted to an end of dipper arm 26 opposite boom arm 24, and is driven by means of hydraulic bucket cylinder 32. Controls and remaining hydraulics (not shown) used by an operator to control backhoe 12 are typically included within cab 20 and frame 16.

Sideshift mount 14 includes main frame 34, slide frame 36, and swing frame 38. Main frame 34 is mounted to loader frame 16 at the rear portion of loader 10, and includes a pair of parallel, vertically spaced and transversely oriented guide rails 40. In the embodiment shown, main frame 34 also includes a pair of stabilizer housings 42, one of which is mounted to each opposite side of guide rail 40. Left and right stabilizers 44L and 44R, respectively, are movably mounted within stabilizer housings 42. Stabilizers 44L and 44R are comprised of legs 46L and 46R, and feet 48L and 48R, respectively. Drive mechanisms including hydraulic cylinders 64L and 64R (FIG. 4) are mounted within housings 42 and are individually controlled by an operator to drive respective stabilizers 44L and 44R between their lowered or extended working position shown in solid lines, and their raised or retracted travel position shown in broken lines.

Slide frame 36 is slidably or otherwise movably mounted to main frame 34 so as to permit backhoe 12 to be positioned at any desired location along the rear portion of loader 10 between stabilizer housings 42. In the embodiment shown, slide frame 36 includes an upper plate member 50 and lower plate member 52 which are mounted with respect to one another in a spaced apart relationship by means of a pair of vertical members 54. Upper plate member 50 extends over the top of the upper guide rail 40, while lower plate member 52 extends under the lower guide rail. An upper flange member 56 is fastened to and extends downward from upper plate member 50 on the forward side of the upper guide rail 40. Lower flange member 58 (FIG. 2) extends upward from a forward edge of lower plate member 52, adjacent the forward side of the lower guide rail 40. Swing frame 38 is mounted to slide frame 36 by means of vertically oriented pivot assembly 60. Hydraulic swing cylinder 62 (FIG. 3) is actuated by an operator to pivotally move swing frame 38, and therefore backhoe 12, with respect to loader 10.

Figure 2:
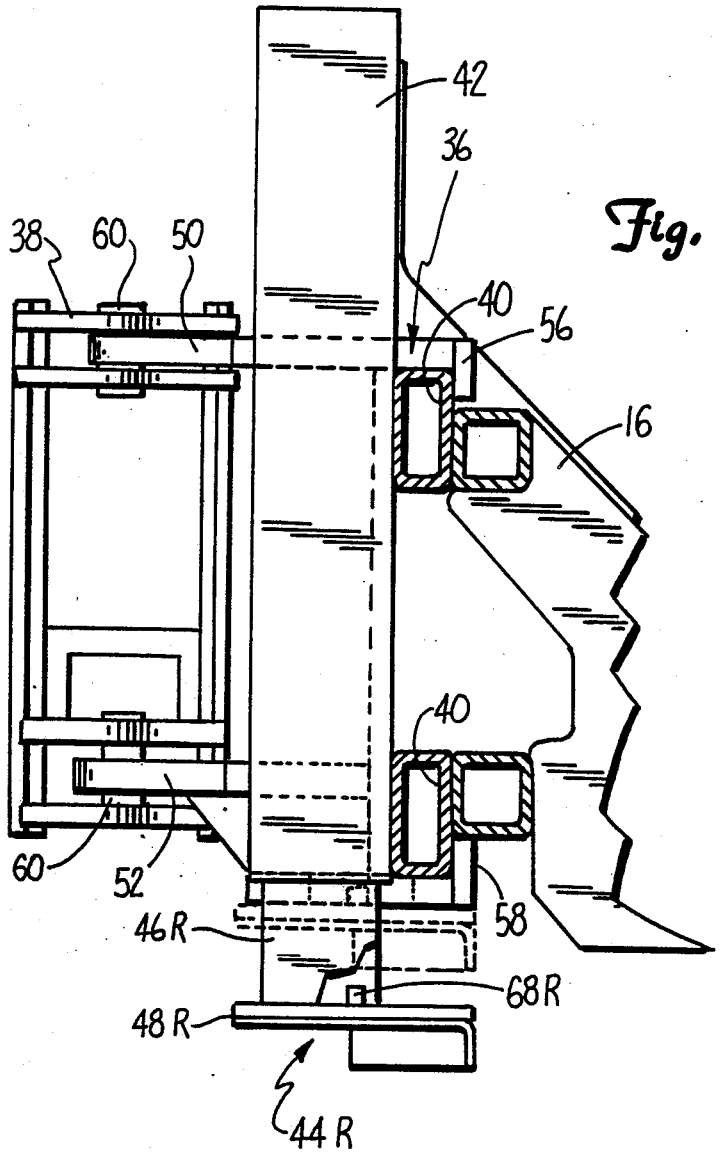
FIG. 2 is a detailed sectional view of the sideshift mount, taken along lines 2—2 in FIG. 1.
Figure 3:
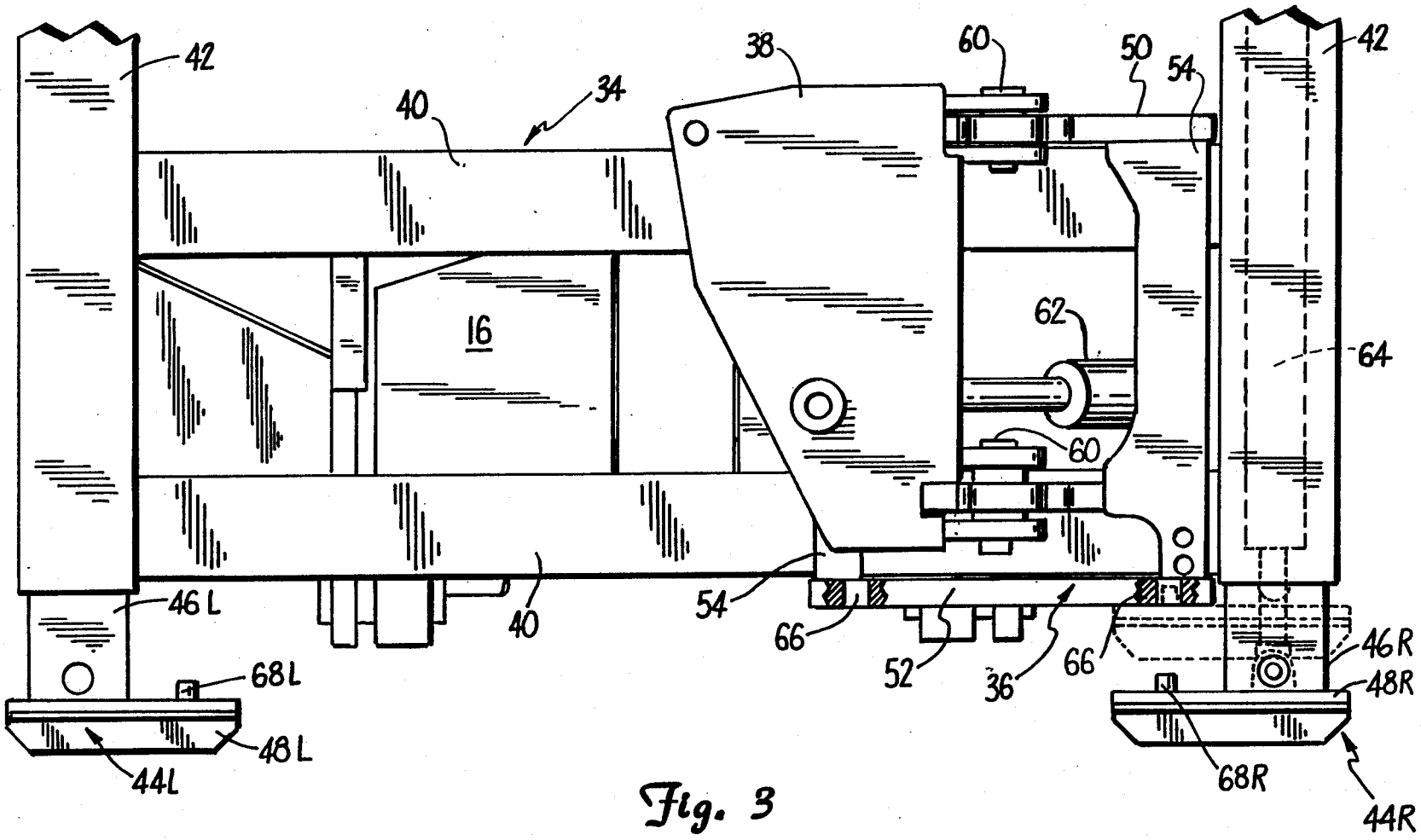
FIG. 3 is a detailed rear view of the sideshift mount shown in FIG. 1, with the loader and backhoe removed for clarity.

Main frame 34 and stabilizers 44L, 44R are illustrated in greater detail in FIGS. 2 and 3. Stabilizers 44L and 44R are driven between their extended and retracted positions by means of double-acting hydraulic stabilizer cylinders 64L and 64R, respecitvely, which are mounted within stabilizer housings 42. Lower plate member 52 of slide mount 36 includes holes or locking apertures 66 which extend upward therein from its lower surface. In the embodiment shown, plate member 52 includes a pair of locking apertures 66, one being positioned adjacent each of the left and right sides of the member. Feet 48L and 48R of stabilizers 44L and 44R also include upwardly extending locking means or pins 68L and 68R, respectively. Locking pins 68L and 68R are of a size which permits them to be fit within locking apertures 66. Locking apertures 66 and locking pin 68R are positioned with respect to one another so as to permit locking pin 68R to fit within and engage locking aperture 66 on the right side of plate member 52 when slide mount 36 is positioned on the rightmost side of main frame 34, and stabilizer 44R is retracted, as illustrated in FIG. 3. Similarly, locking pin 68L will engage locking aperture 66 on the left side of plate 52 when slide mount 36 is positioned on the leftmost side of main frame 34, and stabilizer 44L is retracted.

Figure 4:
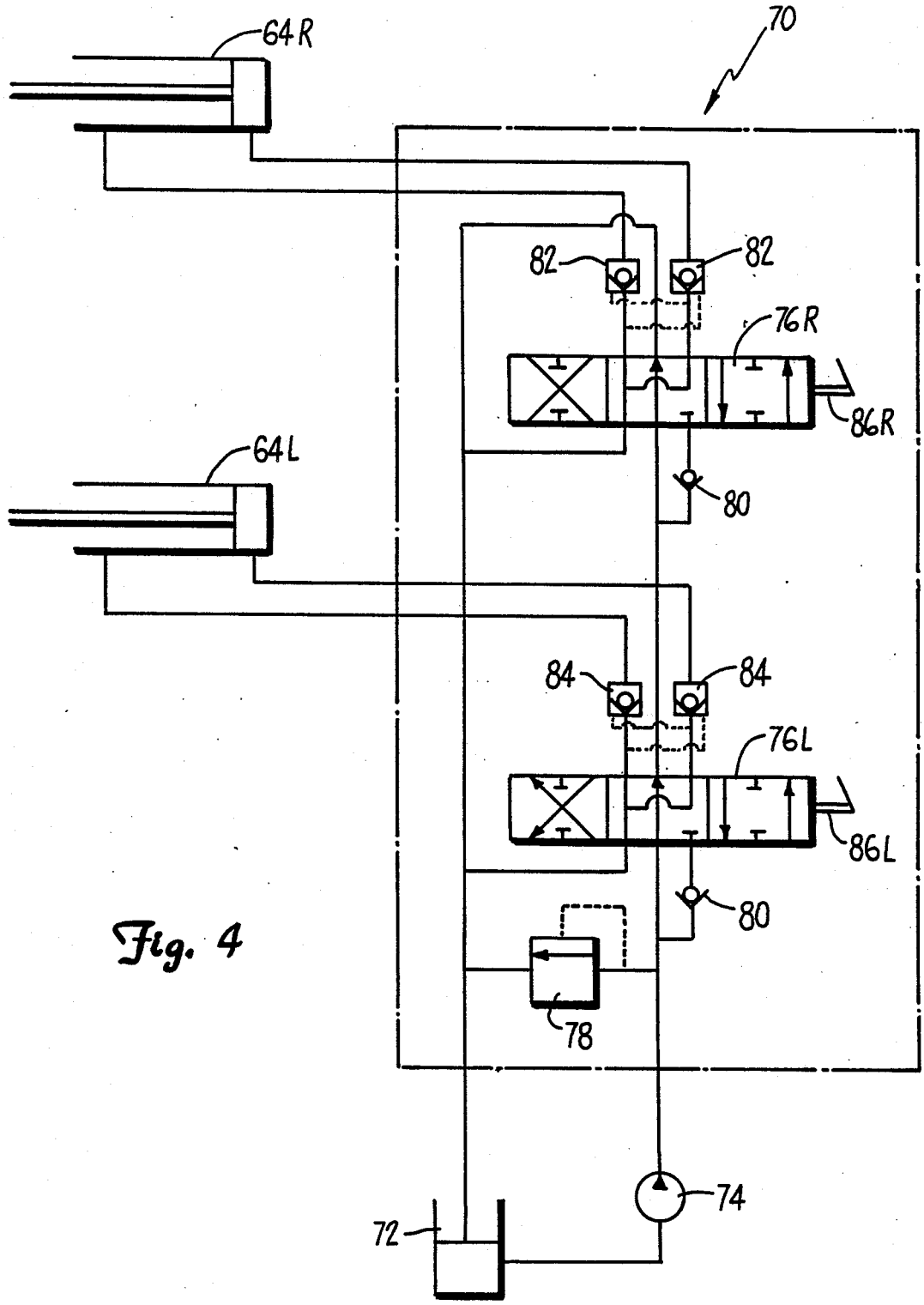
FIG. 4 is a schematic illustration of a hydraulic system which can be used with the locking sideshift mount shown in FIG. 1.

A hydraulic system 70 which can be used to control hydraulic stabilizer cylinders 64L and 64R is illustrated in FIG. 4. As shown, hydraulic system 70 includes a fluid tank or reservoir 72, hydraulic pump 74, three-position, four-way spool valves 76L and 76R, system pressure relief valve 78 and check valves 80. Hydraulic fluid from reservoir 72 is pressurized and provided to spool valves 76L and 76R by pump 74. Spool valve 76R is coupled to cylinder 64R in a hydraulic circuit through hydraulic locks 82. Spool valve 76L is coupled to hydraulic cylinder 64L in a hydraulic circuit through hydraulic locks 84. An operator actuates spool 86R to control the flow of hydraulic fluid to cylinder 64R, and thereby extend and retract stabilizer 44R. An operator controls the position of stabilizer 44L in a similar manner by actuating spool 86L of valve 76L.

An operator will position backhoe 12 at a desired location on sideshift mount 14 by actuating the backhoe's hydraulic cylinders while bucket 28 is positioned against the ground. Slide frame 36 is thereby forced to slide to the desired position on main frame 34. Excavation immediately adjacent a building or other structure can be efficiently performed when slide frame 36 is positioned on the left or right sides of loader 10. When loader 10 is traveling, slide frame 36 and backhoe 12 will be positioned adjacent the leftmost or rightmost sides of the loader. Stabilizers 44L and 44R will then be retracted, with the stabilizer on the same side of loader 10 as backhoe 12 engaging slide frame 36. Backhoe 12 is thereby prevented from moving in the transverse direction along sideshift mount 14. Hydraulic locks 82 and 84 ensure continued engagement of slide frame 36 by stabilizers 44L or 44R when the stabilizers are retracted. Locking sideshift mount 14 is therefore reliable and efficient.

Although the present invention has been described with reference to preferred embodiments, workers skilled in the art will recognize that changes may be made in form and detail without departing from the spirit and scope of the invention.

What is claimed is:

1. A loader having a locking sideshift backhoe, including:

a loader having a rear portion and left and right sides;

a backhoe;

a sideshift mount for movably mounting the backhoe to the rear portion of the loader to permit transverse movement of the backhoe between the left and right sides of the loader, and including a first locking member;

a pair of stabilizers mounted to the rear portion of the loader adjacent opposite sides of the sideshift mount and movable between extended and retracted positions;

a stabilizer drive for driving and positioning the stabilizers between their retracted and extended positions; and a second locking member on at least one of the stabilizers, the second locking member cooperable with the first locking member to engage the sideshift mount to prevent movement of the backhoe on the mount when the stabilizer is driven to its retracted position, and to disengage the sideshift mount and allow backhoe movement when the stabilizer is driven to its extended position.

2. The loader of claim 1 wherein the sideshift mount includes:

a main frame fixedly mounted to the rear portion of the loader; and a slide frame having the first locking member as a portion thereof slidably mounted to the main frame for transverse movement between the left and right sides of the loader, the backhoe being mounted to the slide frame.

3. The loader of claim 2 wherein:

the first locking member of the slide frame includes an aperture;

the stabilizers include feet; and the second locking member includes a pin on the stabilizer foot which engages the first locking member aperture in the slide frame when the slide frame is positioned adjacent a side of the loader and the stabilizer is driven to its retracted position.

4. The loader of claim 3 wherein:

the slide frame includes a lower portion and the first locking member aperture is a downwardly opening aperture in the lower portion; and the second locking member pin includes an upwardly extending pin which extends into the first locking member aperture when the stabilizer is driven to its retracted position.

5. The loader of claim 1 wherein the stabilizer drive includes hydraulic cylinders.

6. Then loader of claim 5 wherein the stabilizer drive further includes:

a tank;

valves coupling the hydraulic cylinders to the tank in a hydraulic circuit; and hydraulic locks coupling the valves and hydraulic cylinders in the hydraulic circuit.

7. A loader having a locking sideshift backhoe, including:

a loader having a rear portion and left and right sides;

a backhoe;

a main mounting frame fixedly mounted to the rear portion of the loader;

a slide mounting frame for slidably mounting the backhoe to the main mounting frame to permit transverse movement of the backhoe between the left and right sides of the loader;

a locking aperture extending into a lower surface of the slide mounting frame;

a pair of stabilizers mounted to the rear portion of the loader adjacent the left and right sides of the main mounting frame and movable between extended and retracted positions;

a stabilizer drive for driving and positioning the stabilizers between their retracted and extended positions; and locking pins extending upward from the stabilizers and cooperable with the locking aperture for engaging the slide mounting frame and preventing movement of the backhoe when the slide mounting frame is positioned adjacent one of the stabilizers and the stabilizer is driven to its retracted position.

8. The loader of claim 7 wherein the stabilizer drive includes hydraulic cylinders.

9. The loader of claim 8 wherein the stabilizers drive includes:

a tank;

valves coupling the hydraulic cylinders to the tank in a hydraulic circuit; and hydraulic locks coupling the valves and hydraulic cylinders in the hydraulic circuit.

* * * * *

UNITED STATES PATENT AND TRADEMARK OFFICE

CERTIFICATE OF CORRECTION

PATENT NO. : 4,921,392

DATED : May 1, 1990

INVENTOR(S) : Oryn B. Wagner

It is certified that error appears in the above-identified patent and that said Letters Patent is hereby corrected as shown below:

Column 5, line 1, delete "Then", insert --The--.

Signed and Sealed this

Sixth Day of August, 1991

*Attest:*

HARRY F. MANBECK, JR.

*Attesting Officer*

*Commissioner of Patents and Trademarks*